US007159892B2

(12) United States Patent
Draper et al.

(10) Patent No.: US 7,159,892 B2
(45) Date of Patent: Jan. 9, 2007

(54) SNOWBOARD BINDING WITH SUSPENSION HEEL LOOP

(75) Inventors: Alexander D. Draper, Seattle, WA (US); Nigel Steere, Seattle, WA (US); Kenneth Wayne Heinle, Snohomish, WA (US)

(73) Assignee: K-2 Corporation, Seattle, WA (US)

( * ) Notice: Subject to any disclaimer, the term of this patent is extended or adjusted under 35 U.S.C. 154(b) by 0 days.

(21) Appl. No.: 10/324,544

(22) Filed: Dec. 19, 2002

(65) Prior Publication Data

US 2004/0119265 A1 Jun. 24, 2004

(51) Int. Cl.
*A63C 9/00* (2006.01)

(52) U.S. Cl. ..... 280/617; 280/14.22

(58) Field of Classification Search ..... 280/618, 280/619, 617, 616, 613, 607, 623, 624, 628, 280/626, 14.22, 14.24, 14.21, 11.36, 633; 36/117.1, 117.9, 117.6, 117.8

See application file for complete search history.

(56) References Cited

U.S. PATENT DOCUMENTS 5,142,798 A * 9/1992 Kaufman et al. ..... 36/117.4
5,167,424 A * 12/1992 Baggio et al. ..... 280/602
5,356,170 A * 10/1994 Carpenter et al. ..... 280/618
5,820,139 A * 10/1998 Grindl ..... 280/14.24
5,967,531 A * 10/1999 Saillet ..... 280/630
6,007,077 A * 12/1999 Moe ..... 280/14.22
6,113,114 A * 9/2000 Zemke et al. ..... 280/14.26
6,116,634 A * 9/2000 Mometti ..... 280/613
6,206,403 B1 * 3/2001 Black et al. ..... 280/618
6,390,492 B1 * 5/2002 Bumgarner et al. ..... 280/607
6,467,795 B1 * 10/2002 Hirayama et al. ..... 280/613
6,520,531 B1 * 2/2003 Gien ..... 280/618
6,578,865 B1 * 6/2003 Chaput ..... 280/617
6,609,720 B1 * 8/2003 Marmonier ..... 280/14.24
6,637,768 B1 * 10/2003 Okajima et al. ..... 280/613
6,672,610 B1 * 1/2004 Freisinger et al. ..... 280/623
6,840,532 B1 * 1/2005 Plassiard ..... 280/623
2002/0027335 A1 3/2002 Hale

FOREIGN PATENT DOCUMENTS

AT 409 933 B 12/2002
FR 2 838 977 A 10/2003

* cited by examiner

*Primary Examiner*—Hau Phan
(74) *Attorney, Agent, or Firm*—Christensen O'Connor Johnson Kindness PLLC

(57) ABSTRACT

A binding includes a suspension heel loop formed by an upper member pivotally connected to the base of the binding frame. The heel loop flexes or moves in a controlled manner with respect to the binding base at the heel end of the binding. A binding having the suspension heel loop provides greater maneuvering and board control, and thus improves rider performance, while providing shock and vibration absorption capabilities for increasing the overall comfort of the binding during use.

29 Claims, 3 Drawing Sheets

SNOWBOARD BINDING WITH SUSPENSION HEEL LOOP

FIELD OF THE INVENTION

The present invention relates generally to bindings for removably attaching an athletic boot to a surface traversing apparatus, such as a snowboard, and more particularly, to heel loop suspension systems for snowboard bindings.

BACKGROUND OF THE INVENTION

Snowboarding has been practiced for many years, and has grown in popularity in recent years, establishing itself as a popular winter activity rivaling downhill skiing. Typically, a rider wears snowboarding boots that are firmly secured to the snowboard so that the rider can control the speed and direction of the snowboard as the rider traverses a snow-covered hill. The snowboarder's boots are secured to the snowboard by a binding system that has one of a variety of overall configurations depending on intended use and rider preferences. Some riders utilize a two-strap binding system, also referred to as a conventional binding system, which includes straps for releasably securing the rider's boot to the snowboard. Other riders utilize a step-in binding system that includes cleat mechanisms integrated into the sole of the snowboard boots that engage with a cleat-engagement mechanism attached to the snowboard.

For those riders utilizing the conventional or two-strap binding systems, the rider typically does so because of the traditional fit and feel associated with such a system that is usually attributable to the lateral flexibility permitted by the binding system and close securement of the boot to the binding frame. Generally described, conventional binding systems include a binding frame in the form of a substantially rigid body having a substantially flat base plate that receives the sole of the boot. The base plate attaches to the board, frequently in an adjustable manner such that the rider can select a particular angle between the boot and the board. The frame typically includes a heel loop formed from medial and lateral sidewalls, and a highback pivotally attached to the sidewalls and contacting a portion of the heel loop. Two pairs of straps are typically included that are attached to the sidewalls, the straps being adapted to extend over the rider's boots and adjustably interconnect with a ratchet buckle, to secure the snowboard boots to the snowboard. The first pair of straps extends generally over the instep of the boot, below the ankle, and the second pair extends generally over the toe portion of the boot.

During use, a certain amount of movement between the boot and the snowboard is needed to initiate turns, perform various tricks and maneuvers, and provide vibration and shock absorption capabilities. To address this need, the conventional bindings described above are usually constructed of various materials, typically plastic, for allowing the heel loop to flex, thereby providing vertical as well as a small amount of lateral or side-to-side movement of the heel loop with respect to the base plate. Other manufacturers have designed their bindings with a slight camber in the base plate to provide the desired flex or movement. However, both of these approaches have their disadvantages. For example, constructing a binding out of plastic sometimes fails to provide the binding with a sufficient strength-to-weight ratio or enough durability typically required in the snowboard industry. With respect to providing camber to the binding, this can induce additional stress into the binding base and the snowboard inserts, as well as cause snowboard distortion.

Thus, there exists a need to provide a binding that provides heel loop movement while addressing the deficiencies of the prior art and others. The present invention is directed to such a binding.

SUMMARY OF THE INVENTION

In accordance with aspects of the present invention, a frame of a binding apparatus having a toe end and a heel end for securing an athletic shoe to a glideboard is provided. The frame includes a base section that is adapted for attachment to the glideboard and has medial and lateral heel end extensions and a bottom surface for supporting the shoe. The frame also includes an upper section having medial and lateral side members and a heel support member interconnecting the medial and lateral side members. The medial and lateral side members are pivotally connected to the base section such that the heel support member is movable between a first position and a second position. The frame further includes a first compressible device that engages against the upper section and the base section. The first compressible device controls the movement of the heel support member between the first and second position, while dampening vibration and absorbing forces applied thereto.

In accordance with another aspect of the present invention, a frame of a binding apparatus for securing a boot to a glideboard is provided. The frame includes a substantially rigid base section having toe and heel ends and medial and lateral sides. The base section also includes a bottom surface for supporting the boot, and a heel end extension upwardly extending from each of the medial and lateral sides of the base section. Each heel end extension forms an opening that is substantially coaxial to the other. The frame also includes an upper section having two spaced-apart fork members pivotally connected to the toe end of the medial and lateral sides of the base section at coaxial pivot connections. The fork members extend rearwardly and interconnect to form a heel support member. Each fork member forms an opening correspondingly dimensioned and alignable with the openings of the heel end extensions. The upper section is movable about the pivot connections along a path of travel between a first position, wherein the respective openings in the heel end extensions and the fork members are in substantial alignment, and a second position, wherein the respective openings are not in alignment. The frame further includes first and second compressible members engaging each of the aligned openings of the respective upper section and the heel end extensions. The compressible members operate to control and dampen the movement of the upper section between the first and the second position.

In accordance with still another aspect of the present invention, a binding for releasable attaching an athletic boot to a surface traversing apparatus is provided. The binding includes a frame that is adapted to be mounted to a surface traversing apparatus. The frame includes a substantially rigid base structure having toe and heel ends and medial and lateral sides. The base section includes a bottom surface for supporting the boot, and a heel end extension upwardly extending from each of the medial and lateral sides of the base structure. Each heel end extension forms an opening that is substantially coaxial to the other. The frame also includes an upper structure including two spaced-apart fork members pivotally connected to the toe end of the medial and lateral sides of the base structure at coaxial pivot connections. The fork members extend rearwardly and interconnect to form a heel support member. Each fork member forms an opening correspondingly dimensioned and alignable with the openings of the heel end extensions. The upper structure is movable about the pivot connections along a path of travel between a first position, wherein the respective openings in the heel end extensions and the fork members are in substantial alignment, and a second position, wherein the openings are not in alignment. The frame further includes a compressible member inserted into and engaging each of the aligned openings of the respective upper member and the heel end extensions. The compressible member controls and dampens the movement of the upper member between the first and the second position. The binding further includes a boot securement member attached to the fork members at the heel end of the frame.

In accordance with yet another aspect of the present invention, a binding for releasable attaching an athletic shoe to a surface traversing apparatus is provided. The binding includes a base member adapted to be mounted to the surface traversing apparatus, and an upper member that includes medial and lateral sides and a heel support member. The binding also includes means for pivotally connecting the medial and lateral sides of the upper member to the base member so that the heel support member moves relative to the base member. The heel support member is movable between a first and a second position. The binding further includes means for dampening the movement of the heel support member between the first and second position and for controlling the movement of the heel support member.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

The present invention will now be described with reference to the accompanying drawings where like numerals correspond to like elements. The present invention is directed to a binding for a glideboard or other surface traversing apparatuses, including but not limited to snowboards, skis, wakeboards, and snowshoes, which provide movement between the athletic shoe or boot of the rider and the glideboard. Specifically, the present invention is directed to a snowboard binding having a heel loop that moves with respect to the binding base plate. More specifically, the present invention is directed to a binding having a suspension heel loop that flexes or moves in a controlled manner with respect to the base plate at the heel end of the binding. The binding of the present invention is designed to provide greater maneuvering and board control, and thus improves rider performance, while providing shock and vibration absorption capabilities for increasing the overall comfort of the binding during use.

Figure 1:
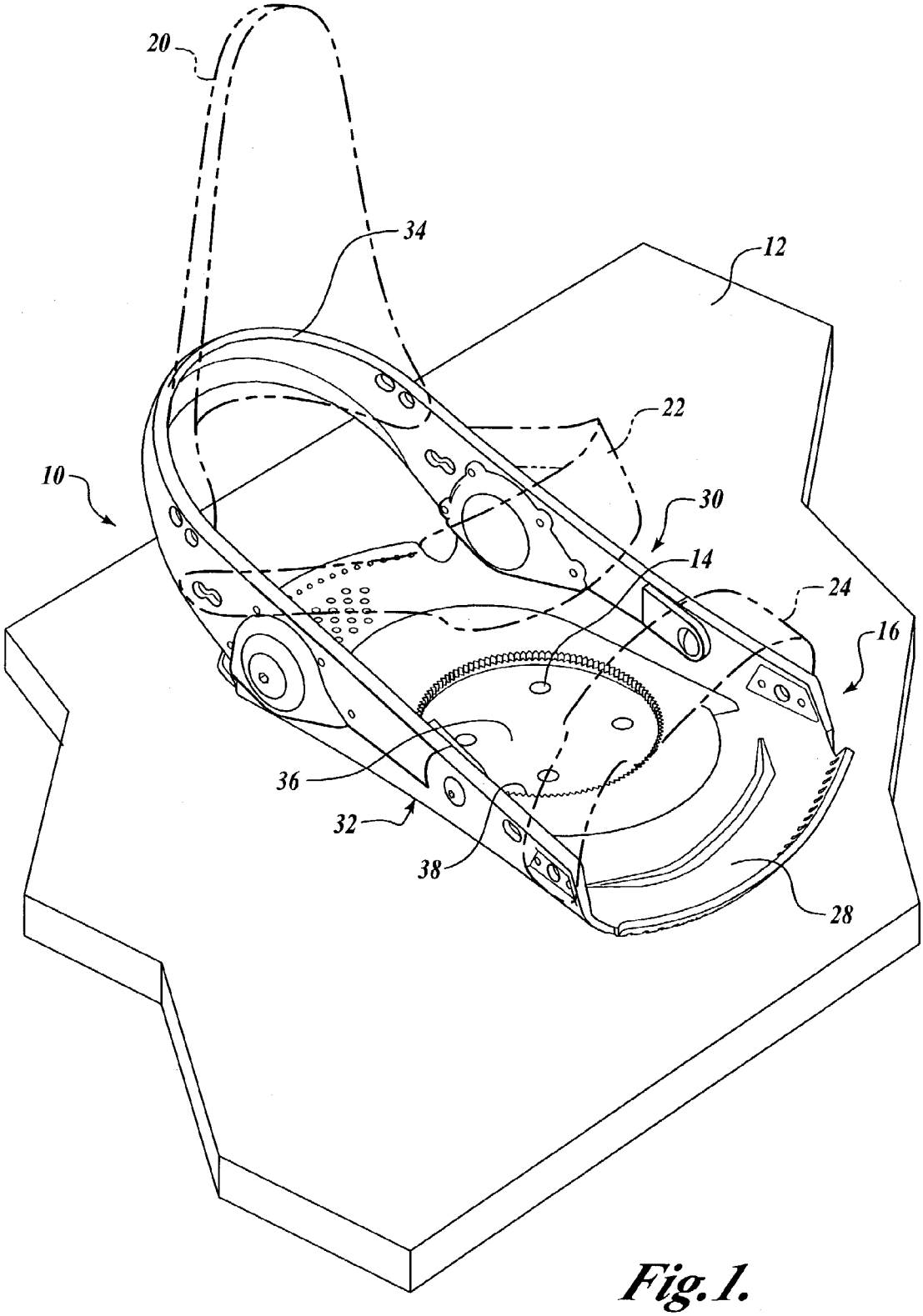
FIG. 1 is a perspective view of a binding formed in accordance with the present invention mounted to a snowboard.

Referring now to FIG. 1, one suitable embodiment of a binding 10, formed in accordance with the present invention, is illustrated in a ready-to-use configuration attached to a snowboard 12. As known in the art, conventional snowboards include threaded inserts 14 within the body thereof into which fasteners (not shown) are secured to hold binding 10 to the top surface of the snowboard 12. To ride the snowboard 12, the snowboarder secures one of his/her snowboard boots (not shown) to binding 10.

The binding 10 includes a frame 16, an ankle strap 22, and a toe strap 24. The frame 16 is the main structural body of the binding 10 and is secured to the snowboard 12 with a rotodisk—not shown, but well known in the art. The rotodisk typically includes rotodisk slots extending parallel to each other in a configuration that matches the pattern of the inserts 14 on the snowboard 12. The rotodisk is a preferred way of attaching the binding 10 to the snowboard 12. However, alternative ways of fastening may be employed without destroying the purpose and function of the present invention. The binding 10 may optionally include a highback 20 pivotally attached at the heel end thereof for rotation along an axis transverse to the longitudinal axis of the frame. The highback 20 extends upward from the frame and functions to limit the rearward movement of the lower leg of the snowboarder in order to provide adequate support in this direction. The ankle strap 22 extends across binding 10 forward of the highback 20. Ankle strap 22 is positioned above and in front of the ankle area of the snowboarder and functions to hold the heel of the boot in place on the binding 10. The toe strap 24 is positioned at the toe end of the frame and functions to secure the toe end of the boot to the binding 10.

The frame 16 is preferably constructed out of a lightweight, high-strength metal, such as aluminum. The frame 16 includes a base plate 28, lateral and medial sidewalls 30 and 32, a heel loop 34, and a rotodisk opening 36. The base plate 28 extends as the base portion of the frame 16 generally in a plane parallel to the upper surface of the snowboard 12 when secured thereto. In the embodiment illustrated in FIG. 1, the base plate 28 is generally rectangular in shape with a cutout forming the rotodisk opening 36 in approximately the center thereof. As seen in FIG. 1, the rotodisk opening 36 includes teeth 38 extending around rotodisk opening 36 on the base plate 28 within a slight recess formed therein. Teeth 38 are conventional in construction and are adapted to secure with a somewhat conventional rotodisk in one embodiment of the invention. The rotodisk opening 36 is round to correspond with the round shape of the rotodisk to enable angular reorientation of the binding 10 relative to the snowboard 12.

The base plate 28 is divided into a toe end and a heel end on either side of rotodisk opening 36. The toe end of the base plate 28 may slope slightly downward toward the toe end of the binding 10. Lateral sidewall 30 may extend upwardly along the side of the base plate 28 to form a rail along the lateral side of the snowboard boot to hold the boot (not shown) in position. Medial sidewall 32 likewise may extend upwardly along the medial side of the boot and the binding 10.

In the embodiment shown, the sidewalls 30 and 32 extend generally perpendicular to the base plate 28, with the sidewalls 30 and 32 increasing in height from the toe end toward the heel end of the base plate 28. As sidewalls 30 and 32 extend further rearwardly, they form the heel loop 34, which interconnects the sidewalls 30 and 32 at the heel end of the binding 10. As the sidewalls 30 and 32 extend rearwardly to form the heel loop 34, they extend above and rearward of the base plate 28 such that the heel loop 34 forms an opening between the heel loop 34 and the base plate 28. Preferably, a lower portion of the highback 20 extends around the inner side of the heel loop 34, with a portion of the highback contacting the top portion of the heel loop 34.

As was described above, and in accordance with an aspect of the present invention, the binding 10 is configured for allowing the heel loop 34 to move in a controlled manner in a somewhat upward or vertical direction (i.e., moves away from a plane defined by the base plate), as will be described in more detail below. Additionally, in one embodiment, the binding 10 is configured for allowing the heel loop 34 to move in a controlled manner in a medial to lateral direction (i.e., the direction perpendicular to the longitudinal axis of the frame), as well as in a somewhat upward or vertical direction. As such, the binding creates a "suspension heel loop" that provides increased performance for riders while dampening vibration and shock applied to the binding during use. One method of forming the suspension heel loop, in which the frame 16 is constructed of two separate components, a base member 60 and an upper member 62, will now be described in detail with reference to FIG. 2. It will be appreciated that other configurations may be utilized to form the suspension heel loop; thus the following is illustrative in nature, and not limiting the scope of the invention, as claimed.

Figure 2:
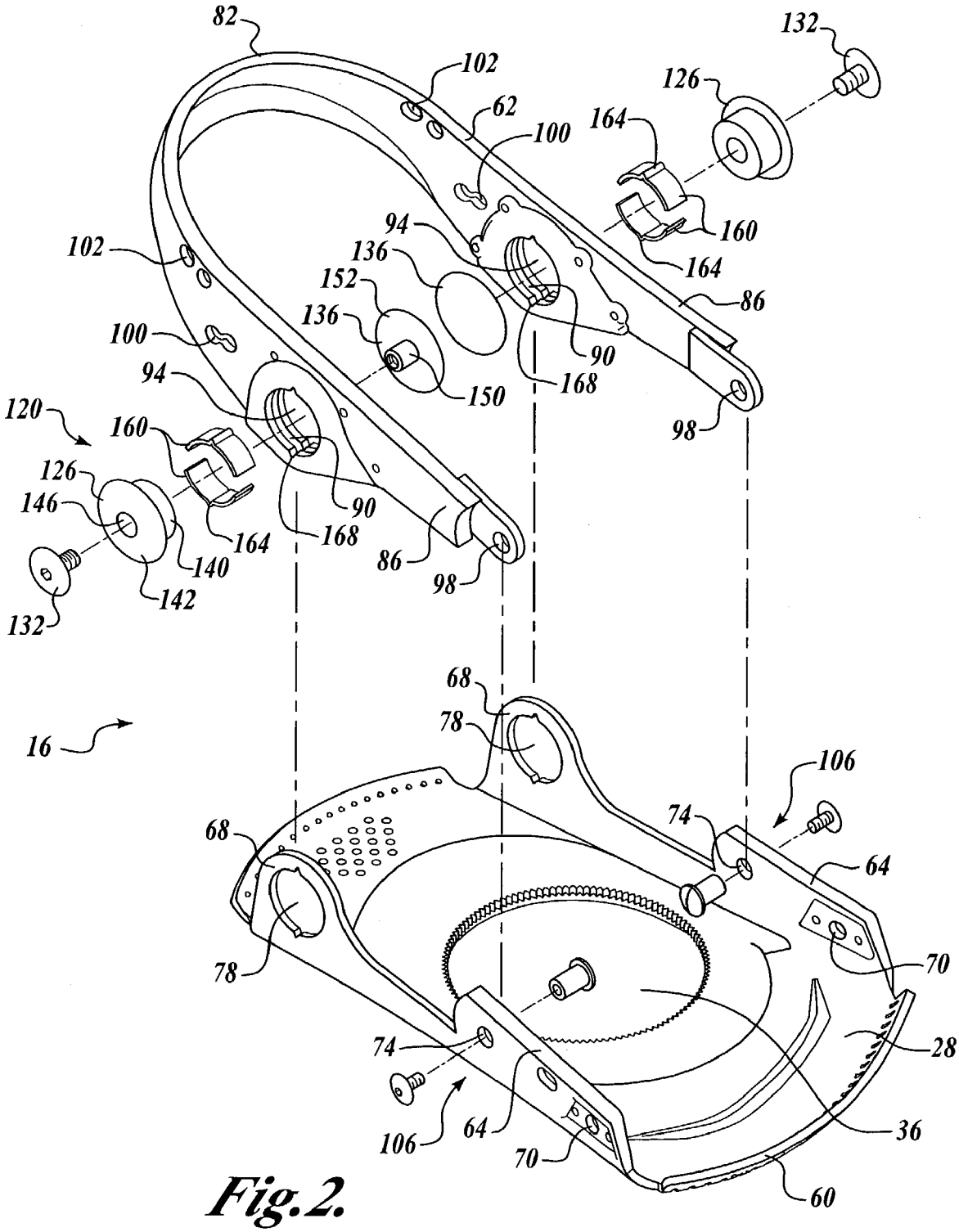
FIG. 2 is an exploded view of the binding frame of FIG. 1.

Referring to FIG. 2, the base member 60 of the frame 16 includes the generally rectangular shaped base plate 28 having the rotodisk opening 36 in the approximate center thereof. At the medial and lateral edges of the base member 60, sides extend in a generally transverse manner having toe end extensions 64 spaced apart from heel end extensions 68. The toe end and heel end extensions 64 and 68 cooperatively form portions of the sidewalls 30 and 32 (FIG. 1). The toe end extensions 64 may include toe strap apertures 70 for receiving fasteners (not shown) for rotatably securing the toe strap to the toe end extensions 64. The toe end extensions 64 also include coaxial pivot apertures 74 positioned toward the heel end of the toe extensions for pivotally connecting the upper member 62 thereto. The heel end extensions 68 extend away from the base plate 28 a farther distance than the toe end extensions 64. Each heel end extension 68 defines an opening 78 substantially coaxial with one another, the purpose of which will be discussed in detail below.

The upper member 62 may be U-shaped, having a closed end 82 that forms the heel loop described above, and two longitudinally extending forks 86, which form a portion of the sidewalls 30 and 32 (FIG. 1). Each fork 86 includes a slot 90 that opens at the bottom of the fork 86. The slots 90 are sized and configured to slidably accept the heel end extensions 68 of the base member 60. Extending into the upstanding sides of the forks 86 at the location of the slots 90 are openings 94 corresponding in shape and size as the openings 78 in the heel end extensions 68. The upper member 62 also includes coaxially aligned apertures 98 at the ends of the forks 86 for pivotal connection with the base member 60. While the upper member 62 is shown in FIG. 1 and FIG. 2 to be pivotally connected to the base member 60 on the inside of the toe end extensions 64, it will be readily apparent that the upper member 62 may be configured to pivotally connect to the outside of the toe end extensions 64. The upper member 62 further includes two sets of apertures 100 and 102 for pivotally connecting the ankle strap and the highback thereto. The sets of apertures 100 and 102 may be configured as detented slots for providing selective longitudinal adjustment of the connection position of the ankle strap or highback, if desired.

Figure 4:
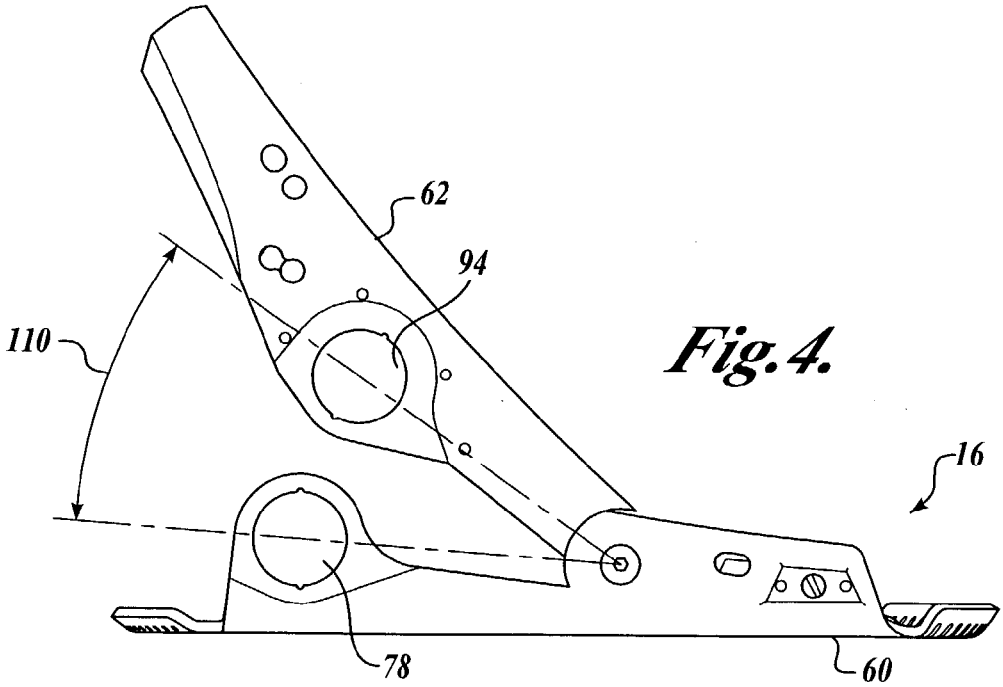
FIG. 4 is a side view of the frame showing the path of travel of the upper member of the frame without restriction from the bushing assembly.

As assembled, the ends of the forks 86 are pinned or otherwise pivotally attached to the heel end portions of the toe end extensions 64 through coaxially aligned apertures 98 and 74 to form pivot connections 106. Thus, the upper member 62 pivots about a pivot axis defined by pivot connections 106, the pivot axis being transverse to the longitudinal axis of the frame 16. The path of travel of the pivoting upper member 62 is an approximate arc, shown in FIG. 4 as numeral 110.

Figure 3:
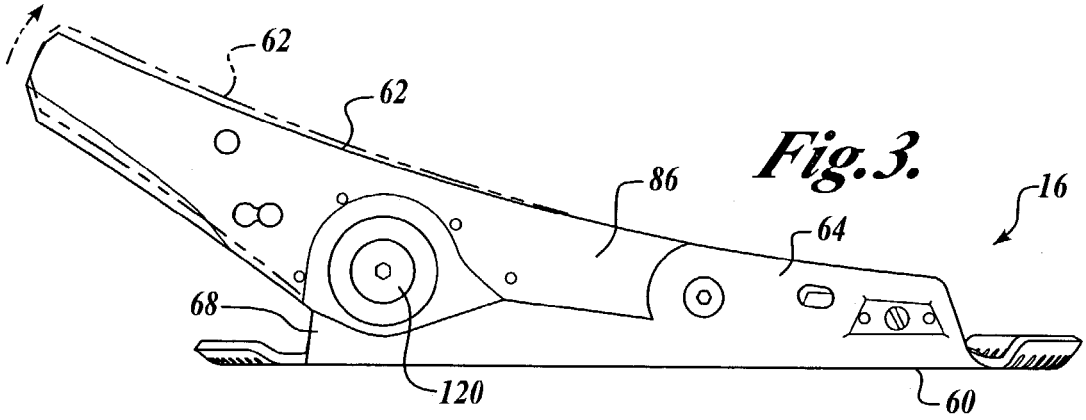
FIG. 3 is a side view of the binding frame illustrating the upper member in the down position, the movement of the upper member is shown in phantom.

Referring now to FIG. 3, in the down or at-rest position, the forks 86 of the upper member 62 are nominally supported by and prevented from pivoting toward the base plate by the upper edge portions of the sides of the base member 60, which are disposed between the heel end and the toe end extensions 64 and 68. In this position, the downwardly open fork slots 90 (FIG. 2) receive the heel end extensions 68, and the openings 78 (FIG. 2) in the heel end extensions are substantially aligned with, and preferably coaxial with, the openings 94 (FIG. 2) of the upper member 62. Thus, the forks 86, in conjunction with the toe end and heel end extensions 64 and 68, form the medial and lateral sidewalls 30 and 32 (FIG. 1). It will be appreciated that the forks 86 may be configured so that they are disposed on either the inside or outside of the heel end extensions 68 in the at-rest position, and thus, obviating the need for the slots 90.

In accordance with one embodiment, the pivot connections 106 are flexible, for example, by having oversized connection apertures 70 and 98, to permit some lateral to medial movement of the upper member 62 with respect to the base member 60. The slots 90 may also be configured slightly oversized to further permit lateral to medial movement of the upper member 62.

Turning back to FIG. 2, the ability of the upper member 62, and therefore, the heel loop to move with respect to the base member 60 is controlled by movement control mechanisms, such as bushing assemblies 120. The bushing assemblies 120 limit the amount of travel of the upper member 62, and provide vibration dampening and shock absorption characteristics during the travel of the upper member. The range of movement of the upper member 62 travel is shown in phantom in FIG. 3 when controlled by the bushing assemblies 120. When assembled, the bushing assemblies 120 are inserted into the aligned openings 78 and 94 (FIG. 2) in the base member 60 and upper member 62, respectively. In FIG. 2, there is shown an exploded view of the bushing assemblies 120 capable of insertion into the aligned openings 78 and 94 in the frame 16 when the upper member 62 is pivoted to the at-rest position. Each bushing assembly 120 includes a bushing 126 and a fastener assembly having a threaded screw 132 and a nut plate 136. It will be readily apparent that the bushing assembly 120 determines the amount of travel and the dampening characteristics of the movement of the upper member 62.

As best shown in FIG. 2, the bushing 126 includes a shaft portion 140 suitable sized and configured to seat within the aligned openings 94 and 78. The bushing 126 includes an oversized head portion 142, preferably generally flat, at an outward end of the shaft portion 140 for prohibiting medial to lateral movement or lateral to medial movement of the bushing 126, depending on which sidewall 30 or 32 (FIG. 1) the bushing is inserted. The shaft portion 140 preferably has a length that is approximately equal to or just slightly larger than the medial or lateral sidewall thickness. The bushing 126 is removably secured within the sidewalls of the frame 16 using any suitable fastening method. In the embodiment shown, the bushing 126 is removably secured to the sidewalls 30 and 32 (FIG. 1) of the frame 16 by the use of a threaded screw 132 and a cooperating nut plate 136. As shown, the screw 132 extends through the bushing center borehole 146 and threadably mates with the inner threaded collar 150 of the nut plate 136, which seats within a portion of the borehole 146. The head 142 of the bushing 126 may be configured with a counterbore for receiving the head of the screw 132. The screw 132 may be provided with a locking patch, such as urethane, nylon, or the like, to resist loosening from the nut plate 136 when subjected to vibration or other forces encountered during use. The nut plate 136 further includes a flat head section 152 dimensioned larger than the openings 94 so as to cooperate with the head 142 of the bushing 126 to retain the bushing assembly in a suitable position during use.

Still referring to FIG. 2, the bushing 126 of each bushing assembly 120 may be constructed of any suitable polymeric or elastomeric material that is capable of compressing and exerting a biasing force against the object compressing the bushing, as well as dampening vibration and shock applied thereto. These materials may include but are not limited to polyurethane or rubber. The biasing force of the bushing 126, typically specified by its spring constant, and/or the durometer hardness of the bushing may be selected for a desired degree of heel loop flex or movement, and dampening characteristics. As used herein, the term "flex" is used synonymous with the movement of the upper member with respect to the base member created by the pivot connection between the upper member and the base plate and controlled by the bushing assembly, and not to the inherent flex or bending of the heel loop due to the material of the binding. It will be appreciated that a set of bushings having varying durometer hardness values may be assembled in a kit so that a user may completely replace or interchange one or both bushings with alternative bushings for either a greater degree of dampening, lesser degree of dampening, or to provide a greater or lesser distance of heel loop travel. It will be further appreciated that the bushings utilized by the binding of the present invention may have the same amount of compressibility or different amounts of compressibility. In one embodiment of the present invention, the total distance of movement between the upper member and the base member is approximately ten (10) millimeters.

The bushing assembly 120 may optionally include shoe halves 160 disposed between the shaft 140 of the bushing 126 and the walls of openings 78 and 94 when assembled. In the embodiment shown, the shoe halves 160 surround the shaft 140 and abut against the head 142. The shoe halves 160 may include protrusions 164, which seat within notches 168 of openings 94 and corresponding notches in openings 78. During use, when force is applied on the shoe halves 160 from the shearing movement of the openings 94 with respect to the openings 78, the force is distributed on the bushing 126 by the shoe halves 160. Thus, by distributing the forces around the shaft 140 of the bushing 126, the life of the bushing 126 is prolonged, and a more uniform and consistent dampening movement of the upper member 62 may be achieved. The shoe halves 160 are preferably constructed of stainless steel, however, other non-corrosive metals, plastics or other materials may be used. It will be apparent that when the shoe halves 160 are utilized with the bushing assemblies 120, the dimensions of the shaft 140 of the bushing 126 decrease accordingly by the thickness of the shoe halves 160 so that the bushing 126, in conjunction with the shoe halves 160, can seat within the openings 74 and 94.

Figure 5:
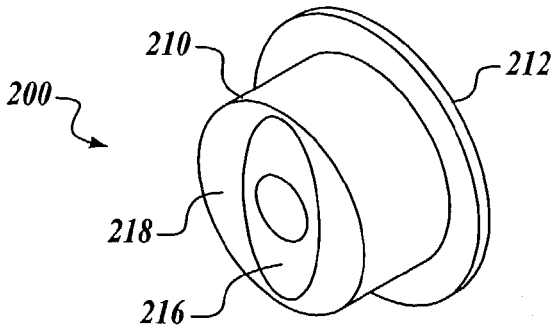
FIG. 5 is a perspective view of an alternative embodiment of a bushing utilized by the binding of FIG. 1 to restrict and control the movement of the upper member from the path shown in FIG. 4 to that shown in phantom in FIG. 3.

Other methods of providing selective amounts of travel or dampening characteristics may also be practiced with the present invention. Turning now to FIG. 5, there is shown a perspective view of an alternative bushing 200 for use in the bushing assembly of the binding 10. The bushing 200 is substantially identical in construction and materials to the bushing 126 (FIG. 2) described above, except for the differences that will now be described. The bushing 200 includes a shaft portion 210 suitably sized and configured to seat within the aligned openings at the frame. The bushing 200 includes an oversized head 212, preferably generally flat, at an outer end of the shaft portion 210. The bushing 200 may further include an inner core 216 and an outer layer 218 that surrounds the inner core 216. In the embodiment shown, the width of the inner core 216 is dimensioned smaller than its height, with the inner core 216 being stiffer than the outer layer 218. As such, it will be appreciated that by rotating the bushing 200 within the aligned openings of the frame such that the length dimension of the inner core 216 is oriented between a range of selected positions, the rider can tune or select the desired riding characteristics of the binding. For example, it will be appreciated that the riding characteristics (e.g., amount of flex and dampening) for the binding having a bushing 200 aligned such that the elongated core 216 is parallel to the direction of the force applied to the bushing 200 by movement of the upper member is different than the riding characteristics for the binding having a bushing 200 aligned such that the elongated core 216 is perpendicular to the direction of the force applied to the bushing 200 by the same movement of the upper member. While the inner core 216 is shown to be elongated in configuration, it will be appreciated that the inner core 216 may have many other configurations that can provide adjustability and tunability of the riding characteristics of the binding.

In either embodiment shown in FIG. 2 or FIG. 5, the user can apply a preload force on the bushing 126 or 200 to change the flex and dampening characteristics of the binding 10. In these embodiments, the user can rotate the screw to compress the bushing in the medial to lateral direction. By compressing the bushing laterally, a preload is formed in the bushing, which requires an increase in the forces applied perpendicular to the lateral compression forces to compress the bushing.

The operation of the binding 10 will now be described with reference to FIGS. 1–4. Once the boot (not shown) is secured to the binding 10 by the ankle straps 22 and the toe straps 24, with the heel of the boot in contact with the highback 20, the rider is ready to traverse a snow covered slope. During the traverse, the rider may want to execute a toe side turn, in which he/she leans over the toe end of the binding 10 or bend his/her knees to engage the opposite or toe edge of the snowboard 12 with the snow. When the rider executes the toe side turn, the boot engages the ankle strap 22, which imparts a force on the heel loop 36, due to the connection of the ankle strap 22 to the heel loop 36. The force imparted on the heel loop 36 causes the upper member 62 to pivot about the pivot connection 106 in a direction away from the heel end of the base member 60. As the upper member 62 pivots, the fork members 86 begin to separate from the heel end extensions 68, and the walls of the openings 94 engage with and compress the bushing 126. If the shoes 160 are being utilized to distribute the load, the fork member walls that define the openings 94 impart a force against the shoes 160. In either case, it will be appreciated that the upper member 62 moves upwardly away from the base plate 28 while the bushing 126 compresses until the biasing force of the bushing 126 approximately equals the force applied by the upper member 62 thereto. At that time, the movement of the upper member 62 ceases. Thus, the bushing assembly 120 controls the movement of the upper member 62 and determines the distance of travel of upper member 62, while providing dampening thereto.

While the bushing assembly is shown with a fastener to removably secure the bushing within the sidewalls of the frame, it will be appreciated that the fastener may be omitted. In this embodiment, the bushing may be configured to seat tightly within the bores like a plug. Alternatively, the bushing may be sized to provide a slight press fit as the bushing is inserted into the bores. Furthermore, while the bushings and the corresponding openings are shown in the drawings as generally circular in cross-section, other cross-sectional shapes are contemplated to be within the scope of the present invention.

While the suspension heel loop described above and illustrated herein was formed by two separate members, other configurations are possible. For example, the upper member and the base member do not need to be separate components. Instead, the frame may be configured such that the upper member connects with the toe end of the base plate at a "living hinge" or cantilevered connection. In this embodiment, the cantilevered connection creates a specific flex or pivot area for the upper member to pivot with respect to the base member.

The movement control members of the present invention have been described thus far with reference to elastomeric or polymeric bushings. However, other types of compressible devices or dampeners, including springs, dampeners with integrated springs, or hydraulic or pneumatic fluid dampeners, such as piston-driven shock absorbers, may alternately be used.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A frame of a binding apparatus having a toe end and a heel end for securing an athletic shoe to a glideboard, comprising:

a base section including medial and lateral heel end extensions and a bottom surface for supporting the shoe, the base section adapted for attachment to the glideboard;

an upper section including medial and lateral side members and a heel support member interconnecting the medial and lateral side members, the medial and lateral side members pivotally connected to the base section such that the heel support member is movable during use of the binding apparatus about said pivotal connection between a first position and a second position, and a first compressible dynamic load reducing device that exhibits at least dampening or shock-absorbing characteristics, said first compressible dynamic load reducing device engaging against the upper section and the base section at a location spaced from said pivotal connection, wherein compression of said first compressible dynamic load reducing device caused by interaction with the upper section and the base section reduces the movement of the heel support member as the heel support member rotates forwardly toward the toe end from the first position to the second position.

2. The frame of claim 1, further comprising a second compressible dynamic load reducing device engageable against the upper section and the base section.

3. The frame of claim 2, wherein the first compressible dynamic load reducing device engages the medial side member and the medial heel end extension and the second compressible dynamic load reducing device engages the lateral side member and the lateral heel end extension.

4. The frame of claim 2, wherein the first compressible dynamic load reducing device engages the lateral side member and the lateral heel end extension, and the second compressible dynamic load reducing device engages the medial side member and the medial heel end extension.

5. The frame of claim 1, wherein the compressibility of the first compressible dynamic load reducing device is adjustable such that a user may pre-select an amount of vibration dampening and force absorption, as well as an amount of heel support member movement.

6. The frame of claim 1, wherein the first compressible dampening device is selected from a group consisting of a fluid dampener, an elastic dampener, a polymeric dampener, an elastomeric dampener, a polymeric bushing, an elastomeric bushing, a shock absorber, and a spring.

7. A frame of a binding apparatus having a toe end and a heel end for securing an athletic shoe to a glideboard, comprising:

a base section including medial and lateral heel end extensions and a bottom surface for supporting the shoe, the base section adapted for attachment to the glideboard;

an upper section including medial and lateral side members and a heel support member interconnecting the medial and lateral side members, the medial and lateral side members pivotally connected to the base section such that the heel support member is movable during use of the binding apparatus about said pivotal connection, between a first position and a second position;

a first compressible device engaging against the upper section and the base section at a location spaced from the pivotal connection, the first compressible device operable to control the movement of the heel support member between the first and second position, while dampening vibration and absorbing forces applied thereto; and a second compressible device engageable against the upper section and the base section; wherein the first and second compressible devices are polymeric bushings, the bushings imparting a force against the upper section and the heel end extensions when compressed.

8. The frame of claim 7, wherein the orientation of the first and second bushings affects the amount of movement of the upper section.

9. The frame of claim 7, wherein the polymeric bushings are elastomeric bushings.

10. A frame of a binding apparatus for securing a boot to a glideboard, comprising:

a substantially rigid base section having toe and heel ends and medial and lateral sides, the base section including a bottom surface for supporting the boot and a heel end extension upwardly extending from each of the medial and lateral sides of the base section, each heel end extension forming an opening that is substantially coaxial to the other, the base section adapted for attachment to the glideboard;

an upper section comprising two spaced-apart fork members pivotally connected to the medial and lateral sides of the base section at coaxial pivot connections, the fork members extending rearwardly and interconnecting to form a heel support member, the fork members each forming an opening correspondingly dimensioned and alignable with the openings of the heel end extensions, wherein the upper section is movable about the pivot connections along a path of travel between a first position, wherein the respective openings in the heel end extensions and the fork members are in substantial alignment, and a second position, wherein the respective openings are not in alignment; and first and second compressible members engaging each of the aligned openings of the respective upper section and the heel end extensions, the compressible members operable for controlling and dampening the movement of the upper section between the first and the second position.

11. The frame of claim 10, wherein the upper section is pivotally connected to the base section with fasteners.

12. The frame of claim 10, wherein the compressible members are configured such that the amount of movement permitted between the first and second position is adjustable by the user.

13. The frame of claim 10, wherein the compressible members are polymeric bushings inserted in a selectively removable manner into each of the aligned openings of the respective upper section and the heel end extensions.

14. The frame of claim 13, wherein the polymeric bushings are constructed of a material selected from the group consisting of rubber and polyurethane.

15. The frame of claim 13, wherein the bushings include an inner core and an outer layer surrounding the inner core, the inner core being less compressible than the outer layer.

16. The frame of claim 15, wherein the width of the inner core is dimensioned smaller than the height of the core.

17. The frame of claim 13, wherein the bushings are selectively interchangeable with other bushings having one of a plurality of amounts of compressibility.

18. The frame of claim 13, wherein the bushings are selected from a set of bushing having varying amounts of compressibility.

19. The frame of claim 13, wherein the first and second compressible members have substantially identical amounts of compressibility.

20. The frame of claim 13, wherein the bushings are held in place by fasteners.

21. The frame of claim 20, wherein each fastener includes a threaded screw and an internally threaded nut plate.

22. The frame of claim 20, wherein the fasteners are operable to impart a preload on its respective bushing, the preload affecting the compressibility of the bushing.

23. The frame of claim 13, wherein the pivot connections are configured to permit movement of the heel support member toward the medial and lateral sides of the base section.

24. The frame of claim 23, wherein the compressible members control the medial to lateral movement of the heel support member.

25. The frame of claim 13, further comprising load distribution members surrounding the aligned openings of the respective upper section and the heel end extensions.

26. A binding for releasable attaching an athletic boot to a surface traversing apparatus comprising:

a frame adapted to be mounted to a surface traversing apparatus, the frame comprising:

(a) a substantially rigid base structure having toe and heel ends and medial and lateral sides, the base structure includes a bottom surface for supporting the boot, and a heel end extension upwardly extending from each of the medial and lateral sides of the base structure, each heel end extension forming an opening that is substantially coaxial to the other, the base structure adapted for attachment to the surface traversing apparatus;

(b) an upper structure including two spaced-apart fork members pivotally connected to the toe end of the medial and lateral sides of the base structure at coaxial pivot connections, the fork members extending rearwardly and interconnecting to form a heel support member, the fork members each forming an opening correspondingly dimensioned and alignable with the openings of the heel end extensions, wherein the upper structure is movable about the pivot connections along a path of travel between a first position, wherein the respective openings in the heel end extensions and the fork members are in substantial alignment, and a second position, wherein the openings are not in alignment; and (c) a compressible member inserted into and engaging each of the aligned openings of the respective upper structure and the heel end extensions, the compressible members operable for controlling and dampening the movement of the upper structure between the first and the second position; and a boot securement member attached to the fork members at the heel end of the frame.

27. A binding for releasable attaching an athletic shoe to a surface traversing apparatus, comprising;

a base member adapted to be mounted to the surface traversing apparatus;

an upper member including medial and lateral sides and a heel support member;

means for pivotally connecting the medial and lateral sides of the upper member to the base member so that the heel support member moves relative to the base member about said pivotal connection during use of the binding, the heel support member movable between a first and a second position; and elastic means for dampening the movement of the heel support member as the heel support member rotates forwardly toward the toe end from the first position to the second position, wherein the elastic means engages against a portion of the upper member and a portion of the base member at a location spaced from the pivotal connection.

28. The binding of claim 27, further comprising means for adjusting the amount of dampening.

29. The binding of claim 27, further comprising means for selectively adjusting the amount of heel member movement.

* * * * *

UNITED STATES PATENT AND TRADEMARK OFFICE

CERTIFICATE OF CORRECTION

PATENT NO. : 7,159,892 B2
APPLICATION NO. : 10/324544
DATED : January 9, 2007
INVENTOR(S) : A.D. Draper et al.

It is certified that error appears in the above-identified patent and that said Letters Patent is hereby corrected as shown below:

| COLUMN | LINE | ERROR |
|---|---|---|
| 12 | 1 | "releasable attaching" should read --releasably attaching-- |
| 12 | 38 | "releasable attaching" should read --releasably attaching-- |

Signed and Sealed this

Seventh Day of August, 2007

JON W. DUDAS
*Director of the United States Patent and Trademark Office*